US011299690B2

(12) United States Patent
Woodward et al.

(10) Patent No.: US 11,299,690 B2
(45) **Date of Patent: *Apr. 12, 2022**

(54) ADDITIVE CONCENTRATES

(71) Applicant: Infineum International Limited, Abingdon (GB)

(72) Inventors: Philip J. Woodward, Reading (GB); Adam P. Marsh, Witney (GB)

(73) Assignee: Infineum International Ltd.

( * ) Notice: Subject to any disclaimer, the term of this patent is extended or adjusted under 35 U.S.C. 154(b) by 0 days.

This patent is subject to a terminal disclaimer.

(21) Appl. No.: 15/465,651

(22) Filed: Mar. 22, 2017

(65) Prior Publication Data

US 2017/0275552 A1 Sep. 28, 2017

(30) Foreign Application Priority Data

Mar. 22, 2016 (EP) ..... 16161585

(51) Int. Cl.

| | |
|---|---|
| ***C10M 129/74*** | (2006.01) |
| ***C10M 169/04*** | (2006.01) |
| ***C10M 163/00*** | (2006.01) |
| ***C10M 129/54*** | (2006.01) |
| ***C10M 129/68*** | (2006.01) |
| *C10N 10/04* | (2006.01) |
| *C10N 20/04* | (2006.01) |
| *C10N 30/04* | (2006.01) |
| *C10N 30/00* | (2006.01) |
| *C10N 40/25* | (2006.01) |
| *C10N 70/00* | (2006.01) |

(52) U.S. Cl.

CPC ..... *C10M 129/74* (2013.01); *C10M 129/54* (2013.01); *C10M 129/68* (2013.01); *C10M 163/00* (2013.01); *C10M 169/04* (2013.01); *C10M 2203/1006* (2013.01); *C10M 2203/1025* (2013.01); *C10M 2207/129* (2013.01); *C10M 2207/144* (2013.01); *C10M 2207/262* (2013.01); *C10M 2207/283* (2013.01); *C10M 2207/289* (2013.01); *C10M 2207/34* (2013.01); *C10M 2215/28* (2013.01); *C10M 2219/068* (2013.01); *C10N 2010/04* (2013.01); *C10N 2020/04* (2013.01); *C10N 2030/04* (2013.01); *C10N 2030/52* (2020.05); *C10N 2030/70* (2020.05); *C10N 2040/25* (2013.01); *C10N 2040/252* (2020.05); *C10N 2040/255* (2020.05); *C10N 2070/02* (2020.05)

(58) Field of Classification Search

CPC ..... C10M 2207/129; C10M 129/68; C10M 163/00; C10M 169/04; C10M 129/74; C10M 129/54; C10M 2219/068; C10M 2207/283; C10M 2207/34; C10M 2203/1006; C10M 2207/144; C10M 2207/289; C10M 2203/1025; C10M 2207/262; C10M 2215/28; C10N 2210/02; C10N 2010/04; C10N 2040/255; C10N 2040/252; C10N 2030/52; C10N 2030/70; C10N 2070/02; C10N 2030/04; C10N 2040/25; C10N 2020/04

USPC ..... 508/306

See application file for complete search history.

(56) References Cited

U.S. PATENT DOCUMENTS

| | | | |
|---|---|---|---|
| 3,024,195 | A | 3/1962 | Drummond et al. |
| 3,024,237 | A | 3/1962 | Drummond et al. |
| 3,087,936 | A | 4/1963 | Le Suer |
| 3,154,560 | A | 10/1964 | Osuch |
| 3,202,678 | A | 8/1965 | Stuart et al. |
| 3,216,936 | A | 11/1965 | Le Suer |
| 3,254,025 | A | 5/1966 | Le Suer |
| 3,442,808 | A | 5/1969 | Traise et al. |
| 4,152,499 | A | 5/1979 | Boerzel et al. |
| 4,234,435 | A | 11/1980 | Meinhardt et al. |
| 4,954,276 | A | 9/1990 | Gutierrez et al. |
| 5,430,105 | A | 7/1995 | Redpath et al. |
| 6,140,279 | A | 10/2000 | Emert et al. |
| 9,068,135 | B1 | 6/2015 | Yang et al. |
| 2006/0030498 | A1 | 2/2006 | Hartley |
| 2006/0229216 | A1 | 10/2006 | Dowding et al. |
| 2008/0188385 | A1 | 8/2008 | Huang et al. |
| 2014/0106998 | A1 | 4/2014 | Nelson et al. |

FOREIGN PATENT DOCUMENTS

| | | | |
|---|---|---|---|
| EP | 1710294 | A1 | 4/1929 |
| EP | 0355895 | A2 | 2/1990 |
| EP | 0330522 | B1 | 10/1994 |
| EP | 1710294 | A1 | 10/2006 |
| WO | WO-2015183929 | A1 | 12/2015 |

OTHER PUBLICATIONS

U.S. Appl. No. 61/264,871, filed Jun. 11, 2011, Lubrizol Corp.

*Primary Examiner* — Vishal V Vasisth

(57) ABSTRACT

The use of polyalkylenyl succinic anhydrides to stabilise an additive concentrate which includes a salicylate detergent and a nitrogen-free ashless organic friction modifier.

26 Claims, No Drawings

ADDITIVE CONCENTRATES

FIELD OF INVENTION

The present invention relates to additive concentrates for use in forming a lubricating oil composition, in particular for use in forming an internal combustion engine lubricating oil composition, especially an automotive internal combustion engine crankcase lubricating oil composition. More specifically, although not exclusively, the present invention relates to such additive concentrates with improved stability; and, to the use of polyalkenyl succinic anhydride(s) as an additive in such concentrates to improve the stability of and/or stabilise the additive concentrate.

BACKGROUND OF THE INVENTION

Lubricating oil compositions for internal combustion engines commonly comprise various combinations of chemical additives designed to impart improved performance characteristics to the lubricant and thereby the engine. The additives are commonly prepared as an additive concentrate comprising a specific combination of additives for a particular application, which are mixed together with diluent oil. The diluent oil facilitates storage and use. To prepare a fully formulated oil, the additive concentrate is mixed with the required base oil(s) and any additional additives.

An additive concentrate can be stored on the shelf for some time between manufacture and use. Given that the additives comprise a variety of different chemicals, it is not unusual for some of the additives to interact with each other. Whilst the chemicals may not necessarily chemically react with one another, some of them do not mix well together. This can result in undesirable generation of haze and/or sediment and/or gel in the additive concentrate.

Additive concentrate stability (i.e. storage stability to mitigate and/or prevent undesirable haze and/or sediment and/or gel in the additive concentrate) is a key concern to additive concentrate formulators. Interaction of additives can limit the combinations of additives that the formulator can use and means that sometimes an additive combination that is desirable for lubricant performance benefits cannot be used due to additive concentrate instability.

It has long been known to use friction modifiers and combinations of friction modifiers to obtain improved performance including improved anti-wear performance and improved fuel economy. However, conventional friction modifiers may cause additive concentrate instability as a result of poor compatibility of the friction modifiers with other additives present in an additive concentrate. This instability typically becomes increasingly pronounced as the amount of these conventional friction modifiers is increased in the additive concentrate. With the current drive to reduce friction coefficients of lubricants in order to improve fuel economy, it is desirable to use higher treat rates of friction modifier. However, this is not generally possible as it results in unacceptable levels of additive concentrate instability.

Known friction modifiers which are used in automotive lubricating oil compositions include ashless nitrogen-free organic friction modifiers which are long chain hydrocarbyl fatty acid esters (i.e. esters formed by the reaction of a long chain fatty acid (e.g. oleic acid), or suitable derivative thereof, and an alkanol (e.g. glycerol)); such friction modifiers include glycerol mono-oleate (GMO). These friction modifiers are typically not only extremely effective in the lubricating oil composition but also are typically relatively inexpensive compared with, for example, nitrogen-containing friction modifiers. It is therefore desirable to use such ashless nitrogen-free organic friction modifiers in lubricating oil compositions, particularly automotive internal combustion engine lubricating oil combustions.

Metal detergents are additives which are typically included in an additive concentrate for use in forming a lubricating oil composition, particularly automotive internal combustion engine lubricating oil combustions. Metal detergents function both as detergents to reduce or remove deposits and as acid neutralizers or rust inhibitors. Salicylate detergents are typically preferred to sulphonate and/or phenate detergents as they confer advantages in terms of piston cleanliness, TBN retention, rust control and anti-oxidancy performance.

Although it has been known that conventional friction modifiers may cause additive concentrate instability (i.e. storage instability due to interaction of the friction modifier with other additives in the concentrate), particularly when the concentrate includes a relatively large amount of friction modifier, it has now been found that the combination of a particular type of ashless nitrogen-free organic friction modifier, namely a long chain hydrocarbyl fatty acid ester (e.g. glycerol mono-oleate), and a particular type of detergent, namely an alkali or alkaline earth metal salicylate detergent, in an additive concentrate may significantly increase additive concentrate instability (i.e. an increase in storage instability), even when the long chain hydrocarbyl fatty acid ester friction modifier is present in the additive concentrate in a relatively low amount. Consequently, when formulating a lubricating oil composition which includes an alkali or alkaline earth metal salicylate detergent and a long chain hydrocarbyl fatty acid ester friction modifier, particularly such a lubricating oil composition where it is desirable to include a relatively large amount of the friction modifier, the alkali or alkaline earth metal salicylate detergent together with other lubricant additives is typically blended to form an additive concentrate which is then added to an oil of lubricating viscosity (i.e. base stock) and the long chain hydrocarbyl fatty acid ester friction modifier is typically added separately to the lubricating oil composition in the form of a separate package. Accordingly, the present invention aims to solve the aforementioned technical problems of providing a storage stable additive concentrate which includes both an alkali or alkaline earth metal salicylate detergent and an ashless nitrogen-free organic friction modifier which is a long chain hydrocarbyl fatty acid ester, particularly an additive concentrate including such a friction modifier in a relatively large amount. Suitably, the present invention aims to provide such an additive concentrate which exhibits the requisite storage stability, thereby mitigating and/or preventing the formation of haze and/or sediment and/or gelation of the concentrate during storage. Conveniently, such an additive concentrate may permit the formation of a lubricating oil composition containing both an alkali or alkaline earth metal salicylate detergent and an ashless nitrogen-free organic friction modifier which is a long chain hydrocarbyl fatty acid ester, particularly a lubricating oil composition containing a relatively large amount of such a friction modifier, by adding a single additive concentrate to an oil of lubricating viscosity (i.e. base stock).

SUMMARY OF THE INVENTION

In accordance with a first aspect, the present invention provides an additive concentrate for use in forming a lubricating oil composition, the additive concentrate consisting of a diluent oil of lubricating viscosity present in a minor amount of less than 50 mass %, based on the total mass of the additive concentrate, and a plurality of oil-soluble or oil-dispersible additives contained therein, wherein the combined amount of all of said plurality of additives in the additive concentrate is greater than 50 mass % on an active ingredient basis, based on the total mass of the additive concentrate, and wherein the plurality of additives include the following additives: (A) one or more oil-soluble or oil-dispersible alkali metal or alkaline earth metal salicylate detergent(s) present in an amount of greater than or equal to 3.0 mass % on an active ingredient basis, based on the total mass of the additive concentrate; (B) one or more oil-soluble or oil-dispersible ashless nitrogen-free organic friction modifier(s) which is one or more aliphatic ($C_7$ to $C_{29}$) hydrocarbyl fatty acid ester(s) present in an amount of greater than or equal to 0.50 mass % on an active ingredient basis, based on the total mass of the additive concentrate; and, (C) one or more oil-soluble or oil-dispersible poly($C_2$ to $C_6$)alkylenyl succinic anhydride(s) present in an effective amount to stabilise the additive concentrate, wherein the number average molecular weight ($M_n$) of the poly($C_2$ to $C_6$)alkylenyl chain(s) of the one or more poly($C_2$ to $C_6$)alkylenyl succinic anhydride(s) is greater than or equal to 1250 daltons.

It will be appreciated that the term "stabilise the additive concentrate" refers to the storage stability of the additive concentrate as evidenced by the formation of any haze and/or sediment and/or gelation of the concentrate during storage. Preferably, the storage stability of the additive concentrate is assessed at 60° C. and atmospheric pressure, more preferably over a 12 week period, especially using the Storage Stability Test Method as described herein. Suitably, improvements in storage stability of the additive concentrate are believed to be due to mitigating and/or reducing interactions between additives (A) and (B) in the concentrate.

Unexpectedly, it has been found that the inclusion of a poly($C_2$ to $C_6$)alkylenyl succinic anhydride in an additive concentrate typically stabilises and/or improves the storage stability of the additive concentrate when the additive concentrate includes both an alkali or alkaline earth metal salicylate detergent and a friction modifier which is an aliphatic ($C_7$ to $C_{29}$)hydrocarbyl fatty acid ester. It has also been found that by increasing the number average molecular weight of the poly($C_2$ to $C_6$)alkylenyl chain(s) of the poly ($C_2$ to $C_6$)alkylenyl succinic anhydride(s) (e.g. a number average molecular weight of the poly($C_2$ to $C_6$)alkylenyl chain(s) of greater than or equal to 1250 daltons) improves the storage stability of such an additive concentrate. Furthermore, increasing the average succination ratio of the poly($C_2$ to $C_6$)alkylenyl succinic anhydride(s) further improves the storage stability of such an additive concentrate.

Accordingly, the present invention may permit the formulation of a stable additive concentrate (i.e. storage stable additive concentrate) which includes the combination of an alkali or alkaline earth metal salicylate detergent and an ashless nitrogen-free organic friction modifier which is an aliphatic ($C_7$ to $C_{29}$)hydrocarbyl fatty acid ester, particularly an additive concentrate including such a friction modifier in a relatively large amount.

Conveniently, the additive concentrate of the present invention may facilitate the formulation of a lubricating oil composition which includes both an alkali or alkaline earth metal salicylate detergent and a friction modifier which is an aliphatic ($C_7$ to $C_{29}$)hydrocarbyl fatty acid ester, particularly a lubricating oil composition including such a detergent and a relatively large quantity of such an ashless nitrogen-free organic friction modifier, by the addition of a single additive concentrate to an oil of lubricating viscosity (i.e. base stock).

Preferably, the number average molecular weight ($M_n$) of the poly($C_2$ to $C_6$)alkylenyl chain(s) of the one or more poly($C_2$ to $C_6$)alkylenyl succinic anhydride(s), as defined herein, is greater than or equal to 1250, more preferably greater than or equal to 1300, even more preferably greater than or equal to 1350, even more preferably greater than or equal to 1400, even more preferably greater than or equal to 1450, most preferably greater than or equal to 1500, daltons. Preferably, the number average molecular weight ($M_n$) of the poly($C_2$ to $C_6$)alkylenyl chain(s) of the one or more poly($C_2$ to $C_6$)alkylenyl succinic anhydride(s), as defined herein, is less than or equal to 5000, more preferably less than or equal to 4500, even more preferably less than or equal to 4000, even more preferably less than or equal to 3500, most preferably less than or equal to 3000, daltons. The number average molecular weight ($M_n$) of the poly($C_2$ to $C_6$)alkylenyl chain(s) of the one or more poly($C_2$ to $C_6$)alkylenyl succinic anhydride(s), as defined herein, is suitably from 1250 to 5000, preferably from 1350 to 4500, more preferably from 1500 to 4000 daltons. Highly preferred is where the number average molecular weight of the poly($C_2$ to $C_6$)alkylenyl chain(s) of the one or more poly($C_2$ to $C_6$)alkylenyl succinic anhydride(s) is from 1700 to 2500 daltons.

Additionally, it has also been found that increasing the average succination ratio (SR) of the one or more poly($C_2$ to $C_6$)alkylenyl succinic anhydride(s) (C), as defined herein, typically improves the storage stability of and/or further stabilises the additive concentrate. Preferably, the average succination ratio of the one or more poly($C_2$ to $C_6$)alkylenyl succinic anhydride(s) (C), as defined herein, is greater than or equal to 1.35, more preferably greater than or equal to 1.40, even more preferably greater than or equal to 1.45, even more preferably greater than or equal to 1.50, even more preferably greater than or equal to 1.55. Preferably, the average succination ratio of the one or more poly($C_2$ to $C_6$)alkylenyl succinic anhydride(s) (C), as defined herein, is less than or equal to 4.00, more preferably less than or equal to 3.50, even more preferably less than or equal to 3.20, even more preferably less than or equal to 3.00, even more preferably less than or equal to 2.75, even more preferably less than or equal to 2.50. A highly preferred average succination ratio of the one or more poly($C_2$ to $C_6$)alkylenyl succinic anhydride(s) is from 1.35 to 3.50, especially from 1.40 to 3.00, and most especially from 1.50 to 2.75.

Additionally, increasing the average saponification value (SAP value) of the one or more poly($C_2$ to $C_6$)alkylenyl succinic anhydride(s) (C), as defined herein, may improve the storage stability of and/or further stabilise the additive concentrate. Preferably, the average SAP value of the one or more poly($C_2$ to $C_6$)alkylenyl succinic anhydride(s) (C), as defined herein, is greater than or equal to 45, more preferably greater than or equal to 50, even more preferably greater than or equal to 55, even more preferably greater than or equal to 60, even more preferably greater than or equal to 65, even more preferably greater than or equal to 70 mg, even more preferably greater than or equal to 75 KOH/g (as measured in accordance with ASTM D94).

Preferably, the one or more poly($C_2$ to $C_6$)alkylenyl succinic anhydride(s) (C) is one or more polyisobutylenyl succinic anhydride(s) (PIBSA(s)).

Preferably, the one or more aliphatic ($C_7$ to $C_{29}$)hydrocarbyl fatty acid ester(s) (B), as defined herein, represent the only ashless nitrogen-free organic friction modifier(s)

included in the additive concentrate. More preferably, the one or more aliphatic ($C_7$ to $C_{29}$)hydrocarbyl fatty acid ester(s) (B), as defined herein, represent the only ashless organic friction modifier(s) included in the additive concentrate.

Preferably, the one or more alkali or alkaline earth metal salicylate detergent(s) (A), as defined herein, represent the only metal detergent(s) included in the additive concentrate, more preferably the only detergent(s) (i.e. which includes both ash containing and ashless detergents) included in the additive concentrate.

In accordance with a second aspect, the present invention provides a method of forming a lubricating oil composition, preferably an internal combustion engine lubricating oil composition, comprising mixing the additive concentrate of the first aspect of the present invention with an oil of lubricating viscosity (i.e. base stock). Suitably, the internal combustion engine lubricating oil composition is for use in a spark-ignited or compression-ignited internal combustion engine. Suitably, the lubricating oil composition, particularly the internal combustion engine lubricating oil composition, as defined herein, is a crankcase lubricating oil composition, especially an automotive internal combustion engine crankcase lubricating oil composition.

In accordance with a third aspect, the present invention provides the use of one or more oil-soluble or oil-dispersible poly($C_2$ to $C_6$)alkylenyl succinic anhydride(s) (C), as defined herein, as an additive in an effective amount in an additive concentrate to improve the storage stability of the additive concentrate, wherein the number average molecular weight ($M_n$) of the poly($C_2$ to $C_6$)alkylenyl chain(s) of the one or more poly($C_2$ to $C_6$)alkylenyl succinic anhydride(s) is greater than or equal to 1250 daltons, and wherein the additive concentrate consists of a diluent oil of lubricating viscosity present in a minor amount of less than 50 mass %, based on the total mass of the additive concentrate, and a plurality of oil-soluble or oil-dispersible additives contained therein, wherein the combined amount of all of said plurality of additives in the additive concentrate is greater than 50 mass % on an active ingredient basis, based on the total mass of the additive concentrate, and wherein the plurality of additives include at least the following additives: (A) one or more oil-soluble or oil-dispersible alkali metal or alkaline earth metal salicylate detergent(s), as defined herein, present in an amount of greater than or equal to 3.0 mass % on an active ingredient basis, based on the total mass of the additive concentrate; and, (B) one or more oil-soluble or oil-dispersible ashless nitrogen-free organic friction modifier(s) which is one or more aliphatic ($C_7$ to $C_{29}$)hydrocarbyl fatty acid ester(s), as defined herein, present in an amount of greater than or equal to 0.50 mass % on an active ingredient basis, based on the total mass of the additive concentrate.

Suitably, the improvement in storage stability of the additive concentrate is evidenced by mitigating and/or reducing the formation of haze, sediment and/or gelation of the additive concentrate. Preferably, the storage stability of the additive concentrate is assessed at a temperature of 60° C. and atmospheric pressure, more preferably over a 12 week period, especially using the Storage Stability Test Method as described herein.

In accordance with a fourth aspect, the present invention provides the use of one or more oil-soluble or oil-dispersible poly($C_2$ to $C_6$)alkylenyl succinic anhydride(s) (C), as defined herein, wherein the number average molecular weight ($M_n$) of the poly($C_2$ to $C_6$)alkylenyl chain(s) of the one or more poly($C_2$ to $C_6$)alkylenyl succinic anhydride(s) is greater than or equal to 1250 daltons, as an additive in an effective amount in an additive concentrate to improve the compatibility of and/or mitigate interaction between and/or prevent interaction between (A) one or more oil-soluble or oil-dispersible alkali metal or alkaline earth metal salicylate detergent(s), as defined herein, as an additive present in an amount of greater than or equal to 3.0 mass % on an active ingredient basis, based on the total mass of the additive concentrate; and, (B) one or more oil-soluble or oil-dispersible ashless nitrogen-free organic friction modifier(s) which is one or more aliphatic ($C_7$ to $C_{29}$)hydrocarbyl fatty acid ester(s), as defined herein, as an additive present in an amount of greater than or equal to 0.50 mass % on an active ingredient basis, based on the total mass of the additive concentrate, and wherein the additive concentrate consists of a diluent oil of lubricating viscosity present in a minor amount of less than 50 mass %, based on the total mass of the additive concentrate, and a plurality of oil-soluble or oil-dispersible additives, including at least additives (A) and (B), contained therein, and the combined amount of all of said plurality of additives in the additive concentrate is greater than 50 mass % on an active ingredient basis, based on the total mass of the additive concentrate.

Suitably, the improvement in compatibility of and/or the mitigation of and/or the prevention of interaction between said (A) one or more oil-soluble or oil-dispersible alkali metal or alkaline earth metal salicylate detergent(s) and said (B) one or more oil-soluble or oil-dispersible ashless nitrogen-free organic friction modifier(s) in the additive concentrate by the use of the one or more oil-soluble or oil-dispersible poly($C_2$ to $C_6$)alkylenyl succinic anhydride(s) (C) is evidenced by mitigating and/or reducing the formation of haze, sediment and/or gelation of the additive concentrate. Preferably, the formation of haze, sediment and/or gelation of the additive concentrate is assessed at a temperature of 60° C. and atmospheric pressure, more preferably over a 12 week period, especially using the Storage Stability Test Method as described herein. Accordingly, the additive concentrate typically exhibits improved storage stability.

The additive concentrate of the first aspect, and as defined in the second to fourth aspects, of the invention may further include, in addition to additives (A), (B) and (C), one or more oil-soluble or oil-dispersible ashless dispersant(s) (D), preferably one or more oil-soluble or oil-dispersible nitrogen-containing ashless dispersant(s). Preferably, the one or more oil-soluble or oil-dispersible ashless dispersant(s) (D), as defined herein, is present in an amount of greater than or equal to 5 mass %, more preferably greater than or equal to 10 mass %, on an active ingredient basis, based on the total mass of the additive concentrate. Preferably, the one or more oil-soluble or oil-dispersible ashless dispersant(s) (D), as defined herein, is present in an amount of less than or equal to 50 mass %, more preferably less than or equal to 45 mass %, even more preferably less than or equal to 40 mass %, on an active ingredient basis, based on the total mass of the additive concentrate. Although the inclusion of additive (D) in the concentrate is preferred, it is not essential.

The additive concentrate of the first aspect, and as defined in the second to fourth aspects, of the invention may further include, in addition to additives (A), (B) and (C), and optional additive (D) if present, one or more oil-soluble or oil-dispersible dihydrocarbyl dithiophosphate metal salt(s) (E), as defined herein. Preferably, the one or more oil-soluble or oil-dispersible dihydrocarbyl dithiophosphate metal salt(s) (E) is present in an amount of greater than or equal to 2 mass %, more preferably greater than or equal to 3 mass %, on an active ingredient basis, based on the total mass of the additive concentrate. Preferably, the one or more oil-soluble or oil-dispersible dihydrocarbyl dithiophosphate metal salt(s) (E) is present in an amount of less than or equal to 20 mass %, more preferably less than or equal to 15 mass %, on an active ingredient basis, based on the total mass of the additive concentrate. Although the inclusion of additive (E) in the concentrate is preferred, it is not essential.

The additive concentrate of the first aspect, and as defined in the second to fourth aspects, of the invention may further include, in addition to additives (A), (B) and (C), and optional additives (D) and/or (E) if present, one or more oil-soluble or oil-dispersible ashless anti-oxidant(s) (F), as defined herein. Preferably, the one or more oil-soluble or oil-dispersible ashless anti-oxidant(s) (F) is an aminic anti-oxidant, particularly an aromatic amine anti-oxidant, a phenolic anti-oxidant or a combination thereof, especially an aromatic amine anti-oxidant. Preferably, the one or more oil-soluble or oil-dispersible ashless anti-oxidant(s) (F), as defined herein, is present in an amount of greater than or equal to 3 mass %, more preferably greater than or equal to 5 mass %, on an active ingredient basis, based on the total mass of the additive concentrate. Preferably, the one or more oil-soluble or oil-dispersible ashless anti-oxidant(s) (F), as defined herein, is present in an amount of less than or equal to 20 mass %, more preferably less than or equal to 15 mass %, on an active ingredient basis, based on the total mass of the additive concentrate. Although the inclusion of additive (F) in the concentrate is preferred, it is not essential.

The additive concentrate of the first aspect, and as defined in the second to fourth aspects, of the invention may further include, in addition to additives (A), (B) and (C), and optional additives (D), (E) and/or (F), if present, one or more oil-soluble or oil-dispersible co-additives in an amount of from 0.1 to 30 mass % on an active ingredient basis, based on the total mass of the additive concentrate, selected from metal detergents, corrosion inhibitors, pour point depressants, anti-wear agents, friction modifiers, demulsifiers, anti-foam agents, molybdenum compounds and viscosity modifiers.

A preferred additive concentrate of the first aspect, and as defined in the second to fourth aspects, of the invention includes the following additives:

(A) one or more oil-soluble or oil-dispersible alkaline earth metal salicylate detergent(s), as defined herein, present in an amount of greater than or equal to 3.0 mass % on an active ingredient basis, based on the total mass of the additive concentrate;

(B) one or more oil-soluble or oil-dispersible ashless nitrogen-free organic friction modifier(s) comprising one or more aliphatic ($C_7$ to $C_{29}$)hydrocarbyl fatty acid ester(s), as defined herein, present in an amount of greater than or equal to 0.50 mass % on an active ingredient basis, based on the total mass of the additive concentrate; and, (C) one or more oil-soluble or oil-dispersible poly($C_4$) alkylenyl succinic anhydride(s), as defined herein, present in an effective amount to stabilise the additive concentrate, wherein the number average molecular weight ($M_n$) of the poly($C_4$)alkylenyl chain(s) of the one or more poly($C_4$)alkylenyl succinic anhydride(s) is greater than or equal to 1250 daltons; and, optionally one or more additives selected from (D) one or more oil-soluble or oil-dispersible ashless dispersant(s), as defined herein, present in an amount of greater than or equal to 5 mass %, on an active ingredient basis, based on the total mass of the additive concentrate; and/or (E) one or more oil-soluble or oil-dispersible dihydrocarbyl dithiophosphate metal salt(s) (E), as defined herein, present in an amount of greater than or equal to 2 mass %, on an active ingredient basis, based on the total mass of the additive concentrate; and/or (F) one or more oil-soluble or oil-dispersible ashless anti-oxidant(s) (F), as defined herein, present in an amount of greater than or equal to 3 mass %, on an active ingredient basis, based on the total mass of the additive concentrate.

A more preferred additive concentrate of the first aspect, and as defined in the second to fourth aspects, of the invention includes the following additives:

(A) one or more oil-soluble or oil-dispersible calcium salicylate detergent(s), as defined herein, present in an amount of greater than or equal to 5.0 mass % on an active ingredient basis, based on the total mass of the additive concentrate;

(B) glycerol mono-oleate present in an amount of greater than or equal to 0.50 mass % on an active ingredient basis, based on the total mass of the additive concentrate; and, (C) one or more oil-soluble or oil-dispersible polyisobutylenyl succinic anhydride(s), as defined herein, present in an amount of greater than or equal to 0.75 mass % on an active ingredient basis, based on the total mass of the additive concentrate, wherein the number average molecular weight ($M_n$) of the polyisobutylenyl chain(s) of the one or more polyisobutylenyl succinic anhydride (s) is greater than or equal to 1250 daltons; and, optionally one or more additives selected from (D) one or more oil-soluble or oil-dispersible ashless nitrogen-containing dispersant(s), as defined herein (especially a polyisobutylenyl succinimide (PIBSA-PAM) dispersant), present in an amount of greater than or equal to 5 mass %, on an active ingredient basis, based on the total mass of the additive concentrate; and/or (E) one or more oil-soluble or oil-dispersible dihydrocarbyl dithiophosphate zinc salt(s) (E), as defined herein, present in an amount of greater than or equal to 2 mass %, on an active ingredient basis, based on the total mass of the additive concentrate; and/or (F) one or more oil-soluble or oil-dispersible ashless nitrogen containing anti-oxidant(s) (F), as defined herein, present in an amount of greater than or equal to 3 mass %, on an active ingredient basis, based on the total mass of the additive concentrate.

In this specification, the following words and expressions, if and when used, have the meanings given below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or any cognate word. The expression "consists essentially of" permits inclusion of substances not materially affecting the characteristics of the composition to which it applies. The expression "consists of" or cognates means only the stated features, steps, integers components or groups thereof are present to which the expression refers;

"hydrocarbyl" means a chemical group of a compound that contains hydrogen and carbon atoms and that group is bonded to the remainder of the compound directly via a carbon atom. The group may contain one or more atoms other than carbon and hydrogen provided they do not affect the essentially hydrocarbyl nature of the group. Those skilled in the art will be aware of suitable groups (e.g., halo, especially chloro and fluoro, amino, alkoxyl, mercapto, alkylmercapto, nitro, nitroso, sulfoxy, etc.). Preferably, the hydrocarbyl group consists essentially of hydrogen and carbon atoms, unless specified otherwise. More preferably, the hydrocarbyl group consists of hydrogen and carbon atoms, unless specified otherwise. Preferably, the hydrocarbyl group is an aliphatic hydrocarbyl group. The term "hydrocarbyl" includes "alkyl", "alkylene", "alkenyl", "allyl" and "aryl";

"alkyl" means a $C_1$ to $C_{30}$ alkyl group which is bonded to the remainder of the compound directly via a single carbon atom. Unless otherwise specified, alkyl groups may, when there are a sufficient number of carbon atoms, be linear (i.e. unbranched) or branched, be cyclic, acyclic or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl;

"alkylene" is synonymous with "alkanediyl" and means a $C_2$ to $C_{20}$, preferably a $C_2$ to $C_{10}$, more preferably a $C_2$ to $C_6$ bivalent saturated acyclic aliphatic hydrocarbon radical derived from an alkane by removal of a hydrogen atom from two different carbon atoms; it may be linear or branched. Representative examples of alkylene include ethylene (ethanediyl), propylene (propanediyl), butylene (butanediyl), isobutylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene;

"poly(alkylene)" is synonymous with "polyalkene" and means a polymer containing the appropriate alkanediyl repeating group. Such polymers may be formed by polymerisation of the appropriate alkene (e.g. polyisobutylene may be formed by polymerising isobutene);

"poly(alkylenyl)" is synonymous with "poly(alkenyl)" means a polymer substituent group containing the appropriate alkanediyl repeating radical. Suitably, the poly(alkylenyl) substituent group may be formed by reacting the corresponding poly(alkylene) with a reactant (such as maleic anhydride) which introduces a succinic anhydride group onto the poly(alkylene);

"alkenyl" means a $C_2$ to $C_{30}$, preferably a $C_2$ to $C_{12}$, group which includes at least one carbon to carbon double bond and is bonded to the remainder of the compound directly via a single carbon atom, and is otherwise defined as "alkyl";

"alkynyl" means a $C_2$ to $C_{30}$, preferably a $C_2$ to $C_{12}$, group which includes at least one carbon to carbon triple bond and is bonded to the remainder of the compound directly via a single carbon atom, and is otherwise defined as "alkyl";

"aryl" means a $C_6$ to $C_{18}$, preferably $C_6$ to $C_{10}$, aromatic group, optionally substituted by one or more alkyl, halo, hydroxyl, alkoxy and amino groups, which is bonded to the remainder of the compound directly via a single carbon atom. Preferred aryl groups include phenyl and naphthyl groups and substituted derivatives thereof, especially phenyl and alkyl substituted derivatives thereof;

"alkanol" means an alcohol which consists of an alkyl chain having one or more hydroxyl functional groups bonded to carbon atom(s) of the alkyl chain. The term "alkanol" embraces monohydric alkanols such as methanol, ethanol, propanol and butanol, but also polyhydric alkanols;

"polyhydric alkanol" means an alkanol which includes two or more hydroxyl functional groups. More specifically, the term "polyhydric alkanol" embraces a diol, triol, tetrol, and/or related dimers or chain extended polymers of such compounds. Even more specifically, the term "polyhydric alkanol" embraces glycerol, neopentyl glycol, trimethylolethane, trimethylolpropane, trimethylolbutane, pentaerythritol, dipentaerythritol, tripentaerythritol and sorbitol, especially glycerol;

"monocarboxylic acid" means an organic acid, preferably a hydrocarbyl carboxylic acid, which includes a single carboxylic acid functional group;

"aliphatic hydrocarbyl fatty acid" means a monocarboxylic acid having an aliphatic $C_5$ to $C_{29}$, preferably $C_7$ to $C_{29}$, more preferably a $C_9$ to $C_{27}$, most preferably a $C_{11}$ to $C_{23}$ hydrocarbyl chain. Such compounds may be referred to herein as aliphatic ($C_5$ to $C_{29}$), preferably ($C_7$ to $C_{29}$), more preferably ($C_9$ to $C_{27}$), most preferably ($C_{11}$ to $C_{23}$)hydrocarbyl monocarboxylic acid(s) or hydrocarbyl fatty acid(s) (wherein $C_x$ to $C_y$ designates the total number of carbon atoms in the aliphatic hydrocarbyl chain of the fatty acid, the fatty acid itself due to the presence of the carboxyl carbon atom includes a total of $C_{x+1}$ to $C_{y+1}$ carbon atoms). Preferably, the aliphatic hydrocarbyl fatty acid, inclusive of the carboxyl carbon atom, has an even number of carbon atoms. The aliphatic hydrocarbyl chain of the fatty acid may be saturated or unsaturated (i.e. includes at least one carbon to carbon double bond); preferably, the aliphatic hydrocarbyl chain is unsaturated and includes at least one carbon to carbon double bond—such fatty acids may be obtained from natural sources (e.g. derived from animal or vegetable oils) and/or by reduction of the corresponding saturated fatty acid;

"aliphatic hydrocarbyl fatty acid ester" means an ester wherein the monocarboxylic acid functional group of the aliphatic hydrocarbyl fatty acid, as defined herein, has been converted into an ester group. For example, an aliphatic hydrocarbyl fatty acid ester may be obtained by reacting the corresponding aliphatic hydrocarbyl fatty acid, or reactive derivative thereof (e.g. anhydride or acid halide) with an alkanol, as defined herein. Alternatively, or additionally, the aliphatic hydrocarbyl fatty acid ester may be obtained in its natural form e.g. as an aliphatic hydrocarbyl fatty acid glycerol ester. Accordingly, the term "aliphatic hydrocarbyl fatty acid ester" embraces an aliphatic hydrocarbyl fatty acid glycerol ester and also aliphatic hydrocarbyl fatty acid esters obtained by reaction of aliphatic hydrocarbyl fatty acids, or reactive derivatives thereof (e.g. anhydride or acid halide) with an alkanol;

"salicylate soap" means the amount of alkali metal or alkaline earth metal salicylate salt contributed by the one or more alkali metal or alkaline earth metal salicylate detergent(s) exclusive of any overbasing material;

"alkali metal or alkaline earth metal salicylate detergent" includes salicylate soap as defined herein and any overbasing material;

"halo" or "halogen" includes fluoro, chloro, bromo and iodo;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"ashless" in relation to an additive means the additive does not include a metal;

"ash-containing" in relation to an additive means the additive includes a metal;

"major amount" means in excess of 50 mass % of a composition (e.g. the additive concentrate) expressed in respect of the stated component(s) and in respect of the total mass of the composition, reckoned as active ingredient of the component(s);

"minor amount" means less than 50 mass % of a composition (e.g. the additive concentrate), expressed in respect of the stated additive(s) and in respect of the total mass of the composition, reckoned as active ingredient of the additive(s);

"effective amount" in respect of an additive means an amount of such an additive in the composition (e.g. the additive concentrate) that is effective to provide the desired technical effect; and in particular, "an effective amount to stabilise the additive concentrate" means the amount of specified additive that brings about a measurable improvement in additive concentrate stability, as determined in the Storage Stability Test Method described in the Examples herein;

"ppm" means parts per million by mass, based on the total mass of the composition;

"metal content" of a composition or of an additive component, for example molybdenum content or total metal content of the additive concentrate (i.e. the sum of all individual metal contents), is measured by ASTM D5185;

"TBN" in relation to an additive component or of a composition, means total base number (mg KOH/g) as measured by ASTM D2896;

"$KV_{100}$" means kinematic viscosity at 100° C. as measured by ASTM D445;

"phosphorus content" is measured by ASTM D5185;

"sulfur content" is measured by ASTM D2622;

"sulfated ash content" is measured by ASTM D874;

$M_n$ means number average molecular weight and for polymeric entities may be determined by gel permeation chromatography;

$M_w$ means weight average molecular weight and for polymeric entities may be determined by gel permeation chromatography;

Mn in relation to the poly($C_2$ to $C_6$)alkylenyl chain(s) of the poly($C_2$ to $C_6$)alkylenyl succinic anhydride(s) may be considered essentially identical to $M_n$ of the appropriate one or more poly($C_2$ to $C_6$)alkylene(s) used to form the one or more poly($C_2$ to $C_6$)alkylenyl succinic anhydride(s) by reaction with an appropriate reactant (e.g. maleic anhydride);

Mw in relation to the poly($C_2$ to $C_6$)alkylenyl chain(s) of the poly($C_2$ to $C_6$)alkylenyl succinic anhydride(s) may be considered essentially identical to $M_w$ of the appropriate one or more poly($C_2$ to $C_6$)alkylene(s) used to form the one or more poly($C_2$ to $C_6$)alkylenyl succinic anhydride(s) by reaction with an appropriate reactant (e.g. maleic anhydride);

"average succination ratio (SR)" in relation to the one or more oil-soluble or oil-dispersible poly($C_2$ to $C_6$)alkylenyl succinic anhydride(s), as defined herein, is calculated by the following formula when the titrant used to determine the saponification value (SAP) is potassium hydroxide:

$$SR = \frac{MwPA \times SAP}{[(1122 \times A.I.) - (98 \times SAP)}$$

Where:

MwPA is the weight average molecular weight ($M_w$) of the poly($C_2$ to $C_6$)alkylenyl chain(s) of the one or more poly($C_2$ to $C_6$)alkylenyl succinic anhydride(s) (g/mole), which is essentially equivalent to the weight average molecular weight of the poly($C_2$ to $C_6$)alkylene (s) starting material from which the poly($C_2$ to $C_6$)alkylenyl succinic anhydride(s) are derived;

SAP is the saponification value of the poly($C_2$ to $C_6$)alkylenyl succinic anhydride(s) (mg KOH/g) as measured by ASTM D94; and A.I. is the amount of active ingredient of the poly($C_2$ to $C_6$)alkylenyl succinic anhydride(s) (mass %) in the mixture.

The average succination ratio may be deemed to represent essentially the average number of succinic anhydride function groups per poly($C_2$ to $C_6$)alkylenyl chain in the one or more poly($C_2$ to $C_6$)alkylenyl succinic anhydride(s), when taking dilution factors into account;

"saponification value (SAP value)" of the one or more the poly($C_2$ to $C_6$)alkylenyl succinic anhydride(s) is measured in accordance with ASTM D94 (mg KOH/g); and, "stabilise and/or improve the stability of" in relation to the additive concentrate is measured using the Storage Stability Test Method as described herein.

All percentages reported are mass % on an active ingredient basis, i.e. without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined. Accordingly, any upper and lower quantity, range and ratio limits set forth herein associated with a particular technical feature of the present invention may be independently combined with any upper and lower quantity, range and ratio limits set forth herein associated with one or more other particular technical feature(s) of the present invention. Furthermore, any particular technical feature of the present invention, and all preferred variants thereof, may be independently combined with any other particular technical feature(s), and all preferred variants thereof.

Also, it will be understood that the preferred features of each aspect of the present invention are regarded as preferred features of every other aspect of the present invention.

DETAILED DESCRIPTION OF THE INVENTION

The features of the invention relating, where appropriate, to each and all aspects of the invention, are described in more detail as follows:

Diluent Oil

The diluent oil of the additive concentrate of the first aspect of the present invention and the base stock of a lubricating oil composition (sometimes referred to as "base oil") to which the additive concentrate is added to form the lubricant may be selected from natural (vegetable, animal or mineral) and synthetic lubricating oils and mixtures thereof.

The base stock groups are defined in the American Petroleum Institute (API) publication "Engine Oil Licensing and Certification System", Industry Services Department, Fourteenth Edition, December 1996, Addendum 1, December 1998.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Preparation of the additive concentrate may be accomplished by adding the neat additives directly to the diluent oil or by adding them in a form which includes a carrier oil. Suitably, additives included in the additive concentrate may comprise a carrier oil; any such carrier is considered part of the diluent oil of the additive concentrate of the first aspect of the present invention for calculating the composition of the additive concentrate. Additives may be added to the diluent oil by any method known to those skilled in the art, either before, at the same time as, or after addition of other additives.

Examples of oils of lubricating viscosity which may be used as the diluent oil or the base stock for a lubricating oil composition containing the additive concentrate of the present invention are detailed as follows.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the additive concentrate of the present invention, or a lubricating oil composition formed therefrom. Unrefined oils are those obtained directly from a natural or synthetic source without further purification treatment. For example, a shale oil obtained directly from retorting operations, petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Preferably, the volatility of the oil of lubricating viscosity (e.g. diluent oil or base stock of a lubricating oil composition), as measured by the Noack test (ASTM D5880), is less than or equal to 20%, preferably less than or equal to 16%, preferably less than or equal to 12%, more preferably less than or equal to 10%.

Suitably, the diluent oil of the additive concentrate is present in an amount of less than or equal to 45 mass %, preferably less than or equal to 40 mass %, more preferably less than or equal to 40 mass %, even more preferably less than or equal to 35 mass %, based on the total mass of the additive concentrate. Suitably the diluent oil of the additive concentrate is present in an amount of greater than or equal to 5 mass %, preferably greater than or equal to 10 mass 0%, more preferably greater than or equal to 15 mass %, even more preferably greater than or equal to 20 mass %, based on the total mass of the additive concentrate.

Accordingly, the plurality of additives in the additive concentrate are present in corresponding amounts, such that the total amount of the diluent oil and the plurality of additives in the additive concentrate equals 100 mass %, based on the total mass of the additive concentrate. Suitably, the plurality of additives in the additive concentrate are present in an amount of greater than or equal to 55, preferably greater than or equal to 60, more preferably greater than or equal to 65, mass % based on the total mass of the additive concentrate. Suitably, the plurality of additives in the additive concentrate are present in an amount of less than or equal to 95, preferably less than or equal to 90, more preferably less than or equal to 85, even more preferably less than or equal to 80, mass % based on the total mass of the additive concentrate.

Suitably, the diluent oil of the additive concentrate comprises a Group I or Group II base stock, especially a Group I base stock. Preferably, the diluent oil includes greater than or equal to 50 mass %, more preferably greater than or equal to 60 mass %, even more preferably greater than or equal to 70 mass %, especially greater than or equal to 75 mass %, of Group I base stock(s), based on the total mass of the diluent oil.

Salicylate Detergent (A)

A detergent is an additive that reduces formation of piston deposits, for example high-temperature varnish and lacquer deposits, in engines; it normally has acid-neutralising properties and is capable of keeping finely-divided solids in suspension. Most detergents are based on "soaps", that is metal salts of acidic organic compounds. Accordingly, the additive concentrate of the present invention includes an alkali metal or alkaline earth metal salt of salicylic acid as the soap i.e. salicylate soap.

The additive concentrate of the present invention requires the presence of one or more alkali metal or alkaline earth metal salicylate detergent(s) present in an amount (i.e. the combined amount of all alkali or alkaline metal salicylate detergent(s)) of greater than or equal to 3.0 mass % on an active ingredient basis, based on the total mass of the additive concentrate.

Preferably, the one or more alkali metal or alkaline earth metal salicylate detergent(s) is present in an amount (i.e. the combined amount of all alkali or alkaline metal salicylate detergent(s)) of greater than or equal to 5.0 mass 0%, more preferably greater than or equal to 7.5 mass %, on an active ingredient basis, based on the total mass of the additive concentrate. Preferably, the one or more alkali metal or alkaline earth metal salicylate detergent(s) is present in an amount (i.e. the combined amount of all alkali or alkaline metal salicylate detergent(s)) of less than or equal to 30 mass %, more preferably less than or equal to 27.5 mass %, even more preferably less than or equal to 25 mass %, even more preferably less than or equal to 22.5 mass %, even more preferably less than or equal to 20 mass %, on an active ingredient basis, based on the total mass of the additive concentrate.

The salicylic acid(s) are typically prepared by carboxylation, for example by the Kolbe-Schmitt process, of phenoxides. Processes for overbasing the salicylic acid(s) and forming the detergents are known to those skilled in the art.

Detergents generally comprise a polar head with a long hydrophobic tail, the polar head comprising the metal salt of the acidic organic compound. The salts may contain a substantially stoichiometric amount of the metal when they are usually described as normal or neutral salts and would typically have a total base number or TBN at 100% active mass (as may be measured by ASTM D2896) of from 0 to 80. Large amounts of a metal base can be included by reaction of an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN at 100% active mass of 150 or greater, and typically of from 200 to 500 or more.

Suitably, the one or more alkali metal or alkali earth metal salicylate detergent(s), as defined herein, may be neutral or overbased. Suitably, the one or more alkali metal or alkali earth metal salicylate detergent(s) has a TBN at 100% active mass of from 0 to 600 (as may be measured by ASTM D2896). Preferably, the one or more alkali metal or alkaline earth metal salicylate detergent(s), as defined herein, is an overbased alkali metal or alkaline earth metal salicylate detergent. Preferably, the one or more overbased alkali metal or alkaline earth metal salicylate detergent(s), as defined herein, has a TBN at 100% active mass (as may be measured by ASTM D2896) of greater than or equal to 150, preferably greater than or equal to 200, more preferably greater than or equal to 250. Preferably, the one or more overbased alkali metal or alkaline earth metal salicylate detergent(s), as defined herein, has a TBN at 100% active mass (as may be measured by ASTM D2896) of less than or equal to 600, preferably less than or equal to 550, more preferably less than or equal to 500. Suitably, the one or more overbased alkali metal or alkaline earth metal salicylate detergent(s), as defined herein, has a TBN at 100% active mass (as may be measured by ASTM D2896) of from 150 to 600, preferably 150 to 500, more preferably 200 to 500.

Preferably, the one or more alkali metal or alkaline earth metal salicylate detergent(s), as defined herein, is one or more alkali metal or alkaline earth metal $C_8$ to $C_{30}$ alkyl salicylate detergent(s), more preferably one or more alkali metal or alkaline earth metal $C_{10}$ to $C_{20}$ alkyl salicylate detergents(s), most preferably one or more alkali metal or alkaline earth metal $C_{14}$ to $C_{18}$ alkyl salicylate detergent(s). The alkyl group(s) may be linear or branched and examples of suitable alkyl groups include: octyl; nonyl; decyl; dodecyl; pentadecyl; octadecyl; eicosyl; docosyl; tricosyl; hexacosyl; and, triacontyl. The one or more alkali metal or alkaline earth metal salicylate detergent(s), as defined herein, may also include sulfurized derivatives thereof.

Preferably, the one or more alkali metal or alkaline earth metal salicylate detergent(s), as defined herein, is one or more alkaline earth metal salicylate detergent(s). Calcium and magnesium salicylate detergent(s) are particularly preferred, especially calcium salicylate detergent(s), more especially overbased calcium salicylate detergent(s). Accordingly, the most preferred one or more alkaline earth metal salicylate detergent(s) is one or more overbased calcium salicylate detergent(s).

Suitably, the additive concentrate includes one or more alkaline earth metal salicylate detergent(s), as defined herein, especially one or more calcium salicylate detergent (s), in an amount of greater than or equal to 3.0 mass % on an active ingredient basis, based on the total mass of the additive concentrate. Preferably, the additive concentrate includes one or more alkaline earth metal salicylate detergent(s), as defined herein, especially one or more calcium salicylate detergent(s), in an amount of greater than or equal to 5.0 mass %, more preferably greater than or equal to 7.5 mass %, on an active ingredient basis, based on the total mass of the additive concentrate. Preferably, the additive concentrate includes one or more alkaline earth metal salicylate detergent(s), as defined herein, especially one or more calcium salicylate detergent(s), in an amount of less than or equal to 30 mass %, more preferably less than or equal to 27.5 mass %, even more preferably less than or equal to 25 mass %, even more preferably less than or equal to 22.5 mass %, even more preferably less than or equal to 20 mass %, on an active ingredient basis, based on the total mass of the additive concentrate.

Preferably, the additive concentrate includes one or more alkaline earth metal salicylate detergent(s), as defined herein, especially one or more calcium salicylate detergent(s), in an amount of from 3.0 to 30, more preferably from 5.0 to 25, even more preferably 5.0 to 20, mass % on an active ingredient basis, based on the total mass of the additive concentrate.

Other metal containing detergents may be present in the additive concentrate and include oil-soluble salts of neutral and overbased sulfonates, phenates, sulfurized phenates, thiophosphonates and naphthenates of a metal, particularly the alkali or alkaline earth metals, e.g. sodium, potassium, lithium, calcium and magnesium. The most commonly used metals are calcium and magnesium, which may both be present in detergents used in a lubricant, and mixtures of calcium and/or magnesium with sodium. Detergents may be used in various combinations.

According to a preferred aspect of the present invention, the one or more alkali or alkaline earth metal salicylate detergent(s), as defined herein, represent the only metal containing detergent(s) in the additive concentrate (i.e. the one or more alkali or alkaline earth metal salicylate detergent(s) is the sole metal containing detergent present in the additive concentrate). More preferably, the only detergent(s) in the additive concentrate is one or more alkaline earth metal salicylate detergent(s), as defined herein, even more preferably one or more calcium salicylate detergents(s), especially one or more overbased calcium salicylate detergent(s).

Friction Modifier (B)

The additive concentrate includes one or more oil-soluble or oil-dispersible ashless nitrogen-free organic friction modifier(s) (B) which is one or more aliphatic ($C_7$ to $C_{29}$)hydrocarbyl fatty acid ester(s), as defined herein, present in an amount of greater than or equal to 0.50 mass % on an active ingredient basis, based on the total mass of the additive concentrate.

Preferably, the one or more oil-soluble or oil-dispersible aliphatic ($C_7$ to $C_{29}$ hydrocarbyl fatty acid ester(s), as defined herein, is present in an amount of (i.e. the combined amount of all aliphatic ($C_7$ to $C_{29}$)hydrocarbyl fatty acid ester(s)) greater than or equal to 0.75, more preferably greater than or equal to 1.0, even more preferably greater than or equal to 1.25, even more preferably greater than or equal to 1.50, even more preferably greater than or equal to 1.50, even more preferably greater than or equal to 1.75, even more preferably greater than or equal to 2.0, mass % on an active ingredient basis, based on the total mass of the additive concentrate. Preferably, the one or more oil-soluble or oil-dispersible aliphatic ($C_7$ to $C_{29}$) hydrocarbyl fatty acid ester(s), as defined herein, is present in an amount of (i.e. the combined amount of all aliphatic ($C_7$ to $C_{29}$)hydrocarbyl fatty acid ester(s)) less than or equal to 10 mass %, preferably less than or equal to 7.5 mass %, more preferably less than or equal to 5.0 mass %, even more preferably less than or equal to 4.0 mass %, on an active ingredient basis, based on the total mass of the additive concentrate.

Preferably, the one or more oil-soluble or oil-dispersible aliphatic ($C_7$ to $C_{29}$ hydrocarbyl fatty acid ester(s), as defined herein, is present in an amount of from 1.0 to 10.0, more preferably from 1.0 to 5.0, even more preferably from 1.5 to 4.0, mass % on an active ingredient basis, based on the total mass of the additive concentrate.

The one or more aliphatic ($C_7$ to $C_{29}$)hydrocarbyl fatty acid ester(s), as defined herein, may be derived by esterifying the corresponding one or more aliphatic ($C_7$ to $C_{29}$) hydrocarbyl fatty acid(s), and/or a reactive derivative(s) thereof (e.g. anhydride or acid chloride), with an alkanol using routine techniques well known to those skilled in the art. Alternatively, the one or more aliphatic ($C_7$ to $C_{29}$) hydrocarbyl fatty acid ester(s) may be obtained in its natural form e.g. as one or more aliphatic ($C_7$ to $C_{29}$)hydrocarbyl fatty acid glycerol ester(s). Suitably, the term "aliphatic ($C_7$ to $C_{29}$)hydrocarbyl" of the one or more aliphatic ($C_7$ to $C_{29}$)hydrocarbyl fatty acid ester(s), as defined herein, refers to the total number of carbon atoms in the aliphatic hydrocarbyl chain of the one or more aliphatic ($C_7$ to $C_{29}$) hydrocarbyl fatty acid(s) (exclusive of the carbonyl carbon atom of such acid(s)) from which the corresponding ester(s) may be derived therefrom.

Suitable aliphatic hydrocarbyl fatty acid(s) from which the one or more aliphatic ($C_7$ to $C_{29}$)hydrocarbyl fatty acid ester(s) may be derived and/or obtained in the natural esterified form (i.e. the glycerol ester) include one or more aliphatic ($C_7$ to $C_{29}$), preferably ($C_9$ to $C_{27}$), more preferably ($C_{11}$ to $C_{23}$), hydrocarbyl fatty acid(s) (i.e. aliphatic ($C_7$ to $C_{29}$)hydrocarbyl monocarboxylic acid(s)), wherein $C_x$ to $C_y$ designates the total number of carbon atoms in the aliphatic hydrocarbyl chain of the fatty acid, the fatty acid itself due to the presence of the carboxyl carbon atom includes a total of $C_{x+1}$ to $C_{y+1}$ carbon atoms. Preferably, the total number of carbon atoms in the one or more aliphatic hydrocarbyl fatty acid(s), inclusive of the carboxyl carbon atom, is an even number. Suitably, the aliphatic hydrocarbyl chain of the one or more aliphatic ($C_7$ to $C_{29}$)hydrocarbyl fatty acid(s) may be saturated or unsaturated (i.e. including at least one carbon to carbon double bond); preferably, the aliphatic hydrocarbyl chain of the one or more aliphatic ($C_7$ to $C_{29}$) hydrocarbyl fatty acid(s) is unsaturated and includes at least one carbon to carbon double bond. Preferred one or more aliphatic ($C_7$ to $C_{29}$)hydrocarbyl fatty acid(s) include one or more of myristoleic acid, palmitoleic acid, sapienic acid, hexadecatrienoic acid, oleic acid, stearidonic acid, elaidic acid, vaccenic acid, linoleic acid, linoelaidic acid, linolenic acid, arachidonic acid, eicosapentaenoic acid, eicosenoic acid, erucic acid, docosahexaenoic acid, docosahexacnoic acid, tetracosapentaenoic acid and tetracosatetraenoic acid. More preferred one or more aliphatic ($C_7$ to $C_{29}$)hydrocarbyl fatty acid(s) include one or more of oleic acid, linoleic acid and linolenic acid. Oleic acid is especially preferred.

The one or more aliphatic ($C_7$ to $C_{29}$)hydrocarbyl fatty acid(s), as defined therein, or a reactive derivative(s) thereof, may be esterified by reaction with one or more alkanol(s), as defined herein, to form the corresponding one or more aliphatic ($C_7$ to $C_{29}$)hydrocarbyl fatty acid ester(s). Suitable one or more alkanol(s) include monohydric ($C_7$ to $C_{20}$) alkanol(s), polyhydric ($C_2$ to $C_{20}$) alkanol(s), and combinations thereof. Preferably, the one or more alkanol(s) is a polyhydric ($C_2$ to $C_{20}$) alkanol(s), more preferably a polyhydric ($C_2$ to $C_{15}$) alkanol(s). Highly preferred polyhydric ($C_2$ to $C_{20}$) alkanol(s) include glycerol, neopentyl glycol, trimethylolethane, trimethylolpropane, trimethylolbutane, pentaerythritol, dipentaerythritol, tripentaerythritol and sorbitol. Glycerol is especially preferred.

Suitably, preferred one or more aliphatic ($C_7$ to $C_{29}$) hydrocarbyl fatty acid ester(s) include one or more aliphatic ($C_9$ to $C_{27}$), more preferably ($C_{11}$ to $C_{23}$), hydrocarbyl fatty acid ester(s) which may be derived from the corresponding one or more aliphatic ($C_7$ to $C_{29}$)hydrocarbyl fatty acid(s), as defined herein, by reaction with one or more alkanol(s), as defined herein, or which may be obtained in a natural esterified form i.e. aliphatic ($C_7$ to $C_{29}$)hydrocarbyl fatty acid glycerol ester(s). Highly preferred one or more aliphatic ($C_7$ to $C_{29}$)hydrocarbyl fatty acid ester(s) include one or more aliphatic ($C_7$ to $C_{29}$), preferably ($C_9$ to $C_{27}$), more preferably ($C_{11}$ to $C_{23}$), hydrocarbyl fatty acid glycerol ester(s).

The most preferred one or more aliphatic ($C_7$ to $C_{29}$) hydrocarbyl fatty acid ester(s) is glycerol mono-oleate.

According to a preferred embodiment, the additive concentrate includes glycerol mono-oleate in an amount of greater than or equal to 0.50, preferably greater than or equal to 0.75, more preferably greater than or equal to 1.0, even more preferably greater than or equal to 1.25, even more preferably greater than or equal to 1.50, even more preferably greater than or equal to 1.50, even more preferably greater than or equal to 1.75, even more preferably greater than or equal to 2.0, mass % on an active ingredient basis, based on the total mass of the additive concentrate. According to a preferred embodiment, the additive concentrate includes glycerol mono-oleate in an amount of less than or equal to 10, preferably less than or equal to 7.5, more preferably less than or equal to 5.0, even more preferably less than or equal to 4.0, mass % on an active ingredient basis, based on the total mass of the additive concentrate.

Preferably, the one or more aliphatic ($C_7$ to $C_{29}$)hydrocarbyl fatty acid ester(s) (B), as defined herein, represent the only ashless nitrogen-free organic friction modifier(s) included in the additive concentrate. More preferably, the one or more aliphatic ($C_7$ to $C_{29}$)hydrocarbyl fatty acid ester(s) (B), as defined herein, represent the only ashless organic friction modifier(s) included in the additive concentrate. Suitably, in a most preferred embodiment, glycerol mono-oleate is the only ashless nitrogen-free organic friction modifier, more preferably the only ashless friction modifier, present in the additive concentrate.

Succinic Anydride Derivative (C)

The additive concentrate includes one or more oil-soluble or oil-dispersible poly($C_2$ to $C_6$)alkylenyl succinic anhydride(s) (C), as defined herein. The one or more oil-soluble or oil-dispersible poly($C_2$ to $C_6$)alkylenyl succinic anhydride(s) (C), is suitably present in the additive concentrate in an amount effective to stabilise the additive concentrate. The additive package should be considered stabilised if it passes the stability test described herein.

Preferably, the one or more oil-soluble or oil-dispersible poly($C_2$ to $C_6$)alkylenyl succinic anhydride(s), as defined herein, is present in a total amount (i.e. the combination of all poly($C_2$ to $C_6$)alkylenyl succinic anhydride(s)) of greater than or equal to 0.75, more preferably greater than or equal to 1.0, even more preferably greater than or equal to 1.25, even more preferably greater than or equal to 1.50, even more preferably greater than or equal to 1.75, even more preferably greater than or equal to 2.0, mass % on an active ingredient basis, based on the total mass of the additive concentrate. Preferably, the one or more oil-soluble or oil-dispersible poly($C_2$ to $C_6$)alkylenyl succinic anhydride(s), as defined herein, is present in a total amount (i.e. the combination of all poly($C_2$ to $C_6$)alkylenyl succinic anhydride(s)) of less than or equal to 10, more preferably less than or equal to 7.5, even more preferably less than or equal to 5, mass % on an active ingredient basis, based on the total mass of the additive concentrate.

Preferably, the one or more oil-soluble or oil-dispersible poly($C_2$ to $C_6$)alkylenyl succinic anhydride(s), as defined herein, is present in a total amount of from 1.0 to 10, more preferably from 1.5 to 7.5, even more preferably from 2.0 to 7.5, mass % on an active ingredient basis, based on the total mass of the additive concentrate.

The number average molecular weight of the poly($C_2$ to $C_6$)alkylenyl chain(s) of the one or more poly($C_2$ to $C_6$)alkylenyl succinic anhydride(s), as defined herein, is greater than or equal to 1250, preferably greater than or equal to 1300, more preferably greater than or equal to 1350, even more preferably greater than or equal to 1400, even more preferably greater than or equal to 1450, most preferably greater than or equal to 1500, daltons. Preferably, the number average molecular weight of the poly($C_2$ to $C_6$)alkylenyl chain(s) of the one or more poly($C_2$ to $C_6$)alkylenyl succinic anhydride(s), as defined herein, is less than or equal to 7000, more preferably less than or equal to 5000, even more preferably less than or equal to 4000, even more preferably less than or equal to 3500, most preferably less than or equal to 3000, daltons. Highly preferred is where the number average molecular weight of the poly($C_2$ to $C_6$)alkylenyl chain(s) of the one or more poly($C_2$ to $C_6$)alkylenyl succinic anhydride(s) is from 1700 to 3000 daltons.

The number average molecular weight of the poly($C_2$ to $C_6$)alkylenyl chain(s) of the one or more poly($C_2$ to $C_6$)alkylenyl succinic anhydride(s) may be considered to be essentially identical to the number average molecular weight ($M_n$) of the appropriate one or more poly($C_2$ to $C_6$)alkylene (s) used to form the one or more poly($C_2$ to $C_6$)alkylenyl succinic anhydride(s) (e.g. by reaction with an appropriate reactant, such as maleic anhydride).

Preferably, the ratio of the weight average molecular weight ($M_w$) to number average molecular weight ($M_n$), i.e. $M_w/M_n$, of the poly($C_2$ to $C_6$)alkylenyl chain(s) of the one or more poly($C_2$ to $C_6$)alkylenyl succinic anhydride(s) is from 1.5 to 4.0.

Additionally, it has also been found that by increasing the average succination ratio (SR) of the one or more poly($C_2$ to $C_6$)alkylenyl succinic anhydride(s) (C), as defined herein, may improve the stability of and/or stabilise the additive concentrate. Preferably, the average succination ratio of the one or more poly($C_2$ to $C_6$)alkylenyl succinic anhydride(s) (C), as defined herein, is greater than or equal to 1.35, more preferably greater than or equal to 1.40, even more preferably greater than or equal to 1.45, even more preferably greater than or equal to 1.50, even more preferably greater than or equal to 1.55. Preferably, the average succination ratio of the one or more poly($C_2$ to $C_6$)alkylenyl succinic anhydride(s) (C), as defined herein, is less than or equal to 4.00, more preferably less than or equal to 3.50, even more preferably less than or equal to 3.20, even more preferably less than or equal to 3.00, even more preferably less than or equal to 2.75, even more preferably less than or equal to 2.50. A highly preferred average succination ratio of the one or more poly($C_2$ to $C_6$)alkylenyl succinic anhydride(s) is from 1.35 to 3.50, especially from 1.40 to 3.00.

Additionally, it has also been found that by increasing the average saponification value (SAP value) of the one or more poly($C_2$ to $C_6$)alkylenyl succinic anhydride(s) (C), as defined herein, may improve the stability of and/or stabilise the additive concentrate. Preferably, the average SAP value of the one or more poly($C_2$ to $C_6$)alkylenyl succinic anhydride(s) (C), as defined herein, is greater than or equal to 45, more preferably greater than or equal to 50, even more preferably greater than or equal to 55, even more preferably greater than or equal to 60, even more preferably greater than or equal to 65, even more preferably greater than or equal to 70 mg, even more preferably greater than or equal to 75 KOH/g (as measured in accordance with ASTM D94).

Preferably, the one or more poly($C_2$ to $C_6$)alkylenyl succinic anhydride(s), as defined herein, includes one or more poly(ethylenyl) succinic anhydride(s), poly(propylenyl) succinic anhydride(s), poly(butylenyl) succinic anhydride(s), poly(isobutylenyl) succinic anhydride(s) or combinations thereof. More preferably, the one or more poly($C_2$ to $C_6$)alkylenyl succinic anhydride(s) comprises one or more poly($C_4$)alkylenyl succinic anhydrides, even more preferably one or more poly(butylenyl) or poly(isobutylenyl) succinic anhydride(s), especially one or more poly(isobutylenyl) succinic anhydride(s).

In a highly preferred embodiment, the one or more poly($C_2$ to $C_6$)alkylenyl succinic anhydride(s) is one or more poly(isobutylenyl) succinic anhydride(s) (PIBSA(s)). Said one or more poly(isobutylenyl) succinic anhydride(s) may represent the only one or more poly($C_2$ to $C_6$)alkylenyl succinic anhydride(s) included in the additive concentrate.

Preferably, the additive concentrate includes one or more PIBSA(s) in an amount of greater than or equal to 0.75, more preferably greater than or equal to 1.0, even more preferably greater than or equal to 1.25, even more preferably greater than or equal to 1.50, even more preferably greater than or equal to 1.75, even more preferably greater than or equal to 2.0, mass % on an active ingredient basis, based on the total mass of the additive concentrate. Preferably, the additive concentrate includes one or more PIBSA(s) in an amount of less than or equal to 10, more preferably less than or equal to 7.5, even more preferably less than or equal to 5, mass % on an active ingredient basis, based on the total mass of the additive concentrate.

Preferably, the one or more PIBSA(s) is present in an amount of from 1.0 to 10, more preferably from 1.5 to 7.5, even more preferably from 2.0 to 7.5, mass % on an active ingredient basis, based on the total mass of the additive concentrate.

The one or more poly($C_2$ to $C_6$)alkylenyl succinic anhydride(s) may be prepared by routine techniques well known to those skilled in the art, for example as disclosed in U.S. Pat. No. 4,234,435. For example, polyisobutylene (PIB) is readily available by cationic polymerization from butene streams (e.g. using aluminium tri-chloride or boron trifluoride catalysts). Such polyisobutylenes generally contain residual unsaturation in amounts of about one ethylenic double bond per polymer chain, positioned along the chain. In certain embodiments, the polyisobutylene comprises a highly reactive polyisobutylene (HR-PIB), having a terminal vinylidene content of at least 65%, preferably at least 85%. The preparation of such polymers is described, for example, in U.S. Pat. No. 4,152,499. HR-PIB is known and is commercially available under the tradenames Glissopal (BASF) and Ultravis (BP). Functionalisation of the polyalkylene (e.g. PIB) may be achieved by reaction with maleic anhydride or maleic acid using halogen assisted functionalization or the thermal "ene" reaction, to form the appropriate polyalkylenyl succinic anhydride (e.g. PIBSA).

The number average molecular weight (Mn) of the poly ($C_2$ to $C_6$)alkylenyl chain(s) of the one or more poly($C_2$ to $C_6$)alkylenyl succinic anhydride(s) may be controlled/selected by use of the appropriate precursor poly($C_2$ to $C_6$)alkylene(s) starting material having the desired number average molecular weight. The average SAP value of the one or more poly($C_2$ to $C_6$)alkylene succinic anhydride(s) and the average succination ratio of the one or more poly($C_2$ to $C_6$)alkylene succinic anhydride(s) may be controlled by varying the concentrations of reactants (i.e. varying the concentration of poly($C_2$ to $C_6$)alkylene(s) and succinic acylating forming group, e.g. maleic anhydride, to form the poly($C_2$ to $C_6$)alkylenyl succinic anhydride(s).

Ashless Dispersant (D)

The additive concentrate may optionally include one or more oil-soluble or oil-dispersible ashless dispersant(s) (D), preferably one or more oil-soluble or oil-dispersible ashless nitrogen-containing dispersant(s).

Ashless dispersants comprise an oil-soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersants may be, for example, selected from oil-soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Highly preferred ashless dispersant(s) (D), if present, include one or more polyalkylene succinimide(s), especially one or more polyisobutylene succinimide(s) (PIBSA-PAM). Such dispersant(s) are typically formed by reaction of the corresponding polyalkylene succinic anhydride (e.g. PIBSA) with a polyamine (PAM). If one or more ashless(s) dispersant(s), is present, then preferably the one or more polyalkylene succinimide(s), especially one or more polyisobutylene succinimide(s), represent the only ashless containing dispersants in the additive concentrate.

Suitably, if present, the one or more ashless dispersant(s) (D), as defined herein, especially the one or more polyalkylene succinimide(s) (e.g. PIBSA-PAM), is present in an amount of greater than or equal to 5 mass %, more preferably greater than or equal to 10 mass %, even more preferably greater than equal to 15 mass %, on an active ingredient basis, based on the total mass of the additive concentrate. Suitably, if present, the one or more ashless dispersant(s) (D), as defined herein, especially the one or more polyalkylene succinimide(s) (e.g. PIBSA-PAM), is present in an amount of less than or equal to 50 mass %, more preferably less than or equal to 45 mass %, even more preferably less than or equal to 40 mass %, on an active ingredient basis, based on the total mass of the additive concentrate. Although the inclusion of additive (D) in the concentrate is preferred, it is not essential.

Dihydrocarbyl Dithiophosphate Metal Salt (E)

The additive concentrate may optionally include one or more oil-soluble or oil-dispersible dihydrocarbyl dithiophosphate metal salt(s) (E), especially one or more dihydrocarbyl dithiophosphate zinc salt(s) (ZDDP(s)).

Dihydrocarbyl dithiophosphate metal salt(s) wherein the metal may be an alkali or alkaline earth metal, or aluminium, lead, tin, molybdenum, nickel copper, or preferably, zinc, represent anti-wear component(s) that reduce friction and excessive wear. Dihydrocarbyl dithiothosphate metal salt(s) may be prepared in accordance with known techniques by first forming a dihydrocarbyl dithiophosphoric acid (DDPA) usually by reaction of one or more alcohols or phenol with $P_2S_5$ and the neutralizing the formed DDPA with a metal compound.

The preferred one or more zinc dihydrocarbyl dithiophosphate(s) (ZDDP(s)) are oil-soluble salts of dihydrocarbyl dithiophosphoric acids and may be represented by the following formula:

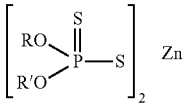

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The one or more zinc dihydrocarbyl dithiophosphate(s) can therefore comprise one or more zinc dialkyl dithiophosphate(s).

Suitably, if present, the one or more dihydrocarbyl dithiophosphate metal salt(s) (E), especially one or more dihydrocarbyl dithiophosphate zinc salt(s) (ZDDP(s)), as defined herein, is present in an amount of greater than or equal to 2 mass %, more preferably greater than or equal to 3 mass %, on an active ingredient basis, based on the total mass of the additive concentrate. Suitably, if present, the one or more dihydrocarbyl dithiophosphate metal salt(s) (E), especially one or more dihydrocarbyl dithiophosphate zinc salt(s) (ZDDP(s)), as defined herein, is present in an amount of less than or equal to 20 mass %, more preferably less than or equal to 15 mass %, on an active ingredient basis, based on the total mass of the additive concentrate. Although the inclusion of additive (E) in the concentrate is preferred, it is not essential.

Anti-Oxidant (F)

The additive concentrate may optionally include one or more oil-soluble or oil-dispersible ashless anti-oxidant(s) (F).

Suitably, the one or more oil-soluble or oil-dispersible ashless anti-oxidant(s) (F) is an aminic anti-oxidant (s), particularly an aromatic amine anti-oxidant, a phenolic anti-oxidant(s) or a combination thereof, especially an aromatic amine anti-oxidant(s) such as a dialkyl substituted diphenylamine(s).

Suitably, if present, the one or more oil-soluble or oil-dispersible ashless anti-oxidant(s) (F), as defined herein, is present in an amount of greater than or equal to 3 mass %, more preferably greater than or equal to 5 mass %, on an active ingredient basis, based on the total mass of the additive concentrate. Suitably, if present, the one or more oil-soluble or oil-dispersible ashless anti-oxidant(s) (F), as defined herein, is present in an amount of less than or equal to 20 mass %, more preferably less than or equal to 15 mass %, on an active ingredient basis, based on the total mass of the additive concentrate. Although the inclusion of additive (F) in the concentrate is preferred, it is not essential.

Co-Additives

Other co-additives, in addition to additives (A), (B) and (C), and optional additives (D), (E) and/or (F), if present, which may be included in the additive concentrate of the present invention, or a lubricating oil compositions derived therefrom, comprise one or more oil-soluble or oil-dispersible co-additives selected from metal-containing detergents, corrosion inhibitors, pour point depressants, anti-wear agents, friction modifiers, anti-foam agents, viscosity modifiers, demulsifiers, and oil-soluble molybdenum compounds. Suitably, such co-additive(s) (i.e. the total amount of all such co-additives) is present in an amount of 0.1 to 30 mass % on an active ingredient basis, based on the total mass of the additive concentrate.

Metal detergents that may be used include oil-soluble neutral and overbased sulfonates, phenates, sulfurized phenates, thiophosphonates, naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents, and mixtures of calcium and/or magnesium with sodium. Combinations of detergents, whether overbased or neutral or both, may be used.

Ashless anti-wear agents may be used and include 1, 2, 3-triazoles, benzotriazoles, sulfurized fatty acid esters and dithiocarbamate derivatives.

The concentrate may also include one or more oil-soluble or oil-dispersible molybdenum compound(s), which include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Suitable molybdenum compounds include mono-, di-, tri- or tetra-nuclear. Dinuclear and trinuclear molybdenum compounds are preferred, especially preferred are trinuclear molybdenum compounds. Suitable molybdenum compounds are preferably organo-molybdenum compound. More preferably, any molybdenum compound is selected from the group consisting of molybdenum dithiocarbamates (MoDTC), molybdenum dithiophosphates, molybdenum dithiophosphinates, molybdenum xanthates, molybdenum thioxanthates, molybdenum sulfides and mixtures thereof. Most preferably, any molybdenum compound is present as a molybdenum dithiocarbamate compound.

Viscosity modifiers (VM) function to impart high and low temperature operability to a lubricating oil. The VM used may have that sole function, or may be multifunctional. Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Other additives are the thio and polythio sulfenamides of thiadiazoles and benzotriazoles derivatives.

A small amount of a demulsifying component may be used. A preferred demulsifying component is described in EP 330,522. It is obtained by reacting an alkylene oxide with an adduct obtained by reacting a bis-epoxide with a polyhydric alcohol.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The individual additive(s) may be incorporated into the diluent oil in any convenient way. Preferably, all the additives except for the viscosity modifier and the pour point depressant are blended into the additive concentrate, and that additive concentrate is subsequently blended into base stock to make a finished lubricant. The additive concentrate will typically be formulated to contain the additive(s) in proper amounts to provide the desired concentration in a fully formulated lubricant when the concentrate is combined with a predetermined amount of a base stock.

The concentrate may be made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

Typically, 2 to 20, preferably 4 to 18, and most preferably 5 to 17, mass % of the additive concentrate is mixed with a corresponding amount of base stock (i.e. the balance of 100 mass %) when formulating a lubricating oil composition.

Typically, the additive concentrate of the present invention suitably contains up to 4, more preferably up to 3, most preferably up to 2, mass % sulphur, based on the total mass of the concentrate and as measured according to ASTM method D4927.

Typically, a lubricating oil composition prepared from the additive concentrate of the present invention suitably contains up to 0.4, more preferably up to 0.3, most preferably up to 0.2, mass % sulphur, based on the total mass of the composition and as measured according to ASTM method D4927.

The additive concentrate of the present invention suitably contains up to and including 12 mass %, preferably up to 10 mass %, even more preferably up to 9 mass % sulphated ash as measured by ASTM D874.

Typically, a lubricating oil composition prepared from the additive concentrate of the present invention suitably contains up to and including 1.2 mass %, preferably up to 1.1 mass %, even more preferably up to 1.0 mass % sulphated ash as measured by ASTM D874.

Typically, the additive concentrate of the present invention suitably contains up to 2.0 more preferably up to 1.5, even more preferably up to 1.0, mass % nitrogen, based on the total mass of the concentrate and as measured according to ASTM method D5291.

Typically, a lubricating oil composition prepared from the additive concentrate of the present invention suitably contains up to 0.30, more preferably up to 0.20, even more preferably up to 0.15, mass % nitrogen, based on the total mass of the composition and as measured according to ASTM method D5291.

Typically, a lubricating oil composition prepared from the additive concentrate of the present invention suitably contains up to and including 1200 ppm, preferably up to and including 1000 ppm, more preferably up to and including 800 ppm, of phosphorus as measured according to ASTM D5185.

Typically, the additive concentrate of the present invention has a total base number (TBN) as measured by ASTM D2896 of from 25 to 100, preferably from 45 to 80.

Typically, a lubricating oil composition prepared from the additive concentrate of the present invention suitably has a total base number (TBN) as measured by ASTM D2896 of from 4 to 15, preferably from 5 to 12.

Preferably, a lubricating oil composition prepared from the additive concentrate of the present invention is a multigrade identified by the viscometric descriptor SAE 20WX, SAE 15WX, SAE 10WX, SAE 5WX or SAE 0WX, where X represents any one of 20, 30, 40 and 50; the characteristics of the different viscometric grades can be found in the SAE J300 classification. More preferably, the lubricating oil composition is in the form of an SAE 10WX, SAE 5WX or SAE 0WX, preferably in the form of an SAE 5WX or SAE 0WX, wherein X represents any one of 20, 30, 40 and 50, especially where X is 20 or 30.

Suitably, the additive concentrate of the present invention is used to form a lubricating oil composition that is used to lubricate mechanical engine components, particularly in internal combustion engines, e.g. spark-ignited or compression-ignited internal combustion engines. Preferably, the additive concentrate of the present invention is used to form a spark-ignited or compression-ignited internal combustion engine lubricating oil composition, more preferably a spark-ignited or compression-ignited internal combustion engine crankcase lubricating oil composition, even more preferably an automotive spark-ignited or compression-ignited internal combustion engine crankcase lubricating oil composition.

EXAMPLES

The invention will now be described in the following examples which are not intended to limit the scope of the claims hereof.

Additive Concentrate Stability

A base additive concentrate was prepared which included (on an active ingredient basis, based on the total mass of the base additive concentrate) the following components/diluent oil: a Group I diluent oil (41.9 mass %); polyisobutylenyl succinimide dispersant (28.4 mass %); overbased calcium salicylate detergent TBN 350 mg KOH/g (9.7 mass %); ZDDP (8.3 mass %); molybdenum dithiocarbamate (0.4 mass %); aminic anti-oxidant (8.6 mass %); and, glycerol mono-oleate (2.7 mass %).

The base additive concentrate was used to form a number of different final additive concentrates, as detailed in Table 1, by top-treating the base additive concentrate with different polyisobutylenyl succinic anhydrides (PIBSAs) in varying amounts. The final additive concentrates, as detailed in Table 1, differed only in the amount of and/or type of PIBSA contained therein; the type of and amount of other components/diluent oil contributed by the base additive concentrate to each of the final additive concentrates being identical. The amount of PIBSA in each of the additive concentrates, as detailed in Tables 1 and 2, is reported on a mass % active ingredient basis, based on the total mass of the additive concentrate.

Three different types of polyisobutylenyl succinic anhydrides (PIBSA A (Comparative), PIBSA 1 and PIBSA 2) were used to form the final additive concentrates, as detailed in Tables 1 and 2, these included:

PIBSA A having a polyisobutylenyl chain of $M_n$ of 1050 daltons, a SAP value of 89 mg KOH/g (ASTM D94) and a succination ratio (SR) of 1.30;

PIBSA 1 having a polyisobutylenyl chain of $M_n$ of 1900 daltons, a SAP value of 76 mg KOH/g (ASTM D94) and a succination ratio (SR) of 1.62;

PIBSA 2 having a polyisobutylenyl chain of $M_n$ of 2300 daltons, a SAP value of 76 mg KOH/g (ASTM D94) and a succination ratio (SR) of 2.25; and, The storage stability of each of the final additive concentrates was evaluated as detailed below.

Storage Stability Test Method 100 ml of the sample to be tested is poured into a centrifuge tube and the tube is supported near-vertically in an oven at 60° C. The condition of all samples was observed and noted initially and at weekly/two weekly intervals for 12 weeks. The centrifuge tube was observed under both natural light and a high intensity light source for sediment. The outside of the centrifuge tube was cleaned with solvent, if required, to ensure a clear view. The following observations were made:

1. Evidence of Sediment

Sediment is hard, solid particles which have collected at the very bottom of the tube. If sediment is present, often there is some light sediment or emulsion with a distinguishable top surface of interface just above the hard sediment. This is referred to as the "Haze Layer" (cuff). The % volume of sediment and % volume of light sediment or emulsion, if present, is recorded. During the inspection of the samples, if the sample showed sediment volume over 0.05 mass %, the sample was deemed to have failed at that point. If there was no sediment by the end of week 12, the result was recorded as 0/10.

2. Visual Inspection

Where no distinguishable hard sediment is present, the sample is assessed visually. The sample is rated in the following categories: (a) no haze, sample is clear and bright; (b) haze only visible under a high intensity light; (c) haze visible under natural light under close inspection; (d) haze visible under natural light without close inspection; (e) opaque; (f) phase separation. If a sample is clear and bright (a) and there is no phase separation then the sample is deemed to have passed. If a sample falls within anyone of categories (b) to (f) then the sample is deemed to have failed.

Stability Test Results of Additive Concentrates

The stability results of a number of final additive concentrates comprising overbased calcium salicylate detergent (9.7 mass %), glycerol mono-oleate (2.7 mass %) and different polyisobutylenyl succinic anhydrides (PIBSAs) in varying amounts, are detailed in Table 1. The results demonstrate that additive concentrates A1 and A2 which include PIBSA A having polyisobutylenyl chains of number average molecular weight ($M_n$) of 1050 daltons, fail the stability test when PIBSA A is present in an amount of 2.2 or even 4.4 mass %, respectively, on an active ingredient basis. Increasing the number average molecular weight ($M_n$) of the polyisobutylenyl chain(s) of the PIBSA from 1050 daltons (PIBSA A) to 1900 daltons (PIBSA 1) produces a stable additive concentrate when the higher molecular weight PIBSA (PIBSA 1) is present in an amount of 3.5 mass % active ingredient (additive concentrate 1). Increasing the amount of PIBSA 1 in the additive concentrate still further to 5.2 mass % active ingredient (additive concentrate 2), also produces a stable additive concentrate. Increasing the number average molecular weight ($M_n$) of the polyisobutylenyl chain(s) of the PIBSA still further from 1900 daltons (PIBSA 1) to 2300 daltons (PIBSA 2), whilst keeping SAP constant, produces a stable additive concentrate when the higher molecular weight PIBSA (PIBSA 2) is present in an amount of 2.4 mass % active ingredient (additive concentrate 3), i.e. a lower amount of PIBSA 2 is required than PIBSA 1 to obtain a stable additive concentrate. Increasing the amount of PIBSA 2 in the additive concentrate still further (additive concentrates 4 and 5) also produces a pass in the stability test.

Thus the results demonstrate: (i) that the inclusion of an effective amount of polyisobutylenyl succinic anhydride with a Mn greater than or equal to 1250 daltons in an additive concentrate comprising glycerol mono-oleate friction modifier and a salicylate detergent improves the stability of and/or stabilises the additive concentrate, and (ii) increasing the number average molecular weight of the polyisobutylenyl chain(s) of the polyisobutylenyl succinic anhydride further improves the stability of and/or stabilises the additive concentrate, allowing for use of a lower treat rate of the polyisobutylenyl succinic anhydride.

TABLE 1

| Concentrate | A1 | A2 | 1 | 2 | 3 | 4 | 5 |
|---|---|---|---|---|---|---|---|
| PIBSA A, mass % (Mn 1050) | 2.2 | 4.4 | | | | | |
| PIBSA 1, mass % (Mn 1900) | | | 3.5 | 5.2 | | | |
| PIBSA 2, mass % (Mn 2300) | | | | | 2.4 | 3.1 | 4.6 |
| Stability Test | | | | | | | |
| Start | Fail | Fail | Pass | Pass | Pass | Pass | Pass |
| 1 week | Fail | Fail | Pass | Pass | Pass | Pass | Pass |
| 2 weeks | Fail | Fail | Pass | Pass | Pass | Pass | Pass |
| 3 weeks | Fail | Fail | Pass | Pass | Pass | Pass | Pass |
| 4 weeks | Fail | Fail | Pass | Pass | Pass | Pass | Pass |
| 6 weeks | Fail | Fail | Pass | Pass | Pass | Pass | Pass |
| 8 weeks | Fail | Fail | Pass | Pass | Pass | Pass | Pass |
| 12 weeks | Fail | Fail | Pass | Pass | Pass | Pass | Pass |

What is claimed is:

1. An additive concentrate for use in forming a lubricating oil composition, the additive concentrate comprising diluent oil of lubricating viscosity present in a minor amount of less than 50 mass %, based on the total mass of the additive concentrate, and a plurality of oil-soluble or oil-dispersible additives contained therein, wherein the combined amount of all of said plurality of additives in the additive concentrate is greater than 50 mass % on an active ingredient basis, based on the total mass of the additive concentrate, and wherein the plurality of additives include the following additives:

(A) one or more oil-soluble or oil-dispersible overbased alkaline earth metal salicylate detergent(s) having a TBN at 100% active mass of 200 to 600 mg KOH/g, as measured in accordance with ASTM D2896 present in an amount of from 5 to 20 mass % on an active ingredient basis, based on the total mass of the additive concentrate wherein the alkaline earth metal is Ca or Mg;

(B) one or more oil-soluble or oil-dispersible ashless nitrogen-free organic friction modifier(s) which is one or more aliphatic ($C_{11}$ to $C_{23}$)hydrocarbyl fatty acid ester(s) present in an amount of from 1.0 to 7.5 mass % on an active ingredient basis, based on the total mass of the additive concentrate wherein the one or more aliphatic ($C_{11}$ to $C_{23}$)hydrocarbyl fatty acid ester(s) is the ester reaction product of one or more aliphatic ($C_{11}$ to $C_{23}$)hydrocarbyl fatty acid(s) and one or more alkanol(s) and the alkanol(s) is a polyhydric ($C_2$ to $C_{20}$) alkanol(s); and, (C) one or more oil-soluble or oil-dispersible poly($C_2$ to $C_6$)alkylenyl succinic anhydride(s) present in an effective amount to stabilise the additive concentrate, wherein:

1) the number average molecular weight ($M_n$) of the poly($C_2$ to $C_6$)alkylenyl chain(s) of the one or more poly($C_2$ to $C_6$)alkylenyl succinic anhydride(s) is 1400 to 7000 daltons;

2) the poly($C_2$ to $C_6$)alkylenyl succinic anhydride(s) is present in an amount of from 1.5 to 7.5 mass % on an active ingredient basis, based on the total mass of the additive concentrate, and has a succination ratio of 1.35 to 4.00;

3) the poly($C_2$ to $C_6$)alkylenyl succinic anhydride(s) comprises one or more poly($C_4$)alkylenyl succinic anhydrides;

and where (A) and (C) are blended into the additive concentrate and the additive concentrate does not show a sediment volume over 0.05 mass %, is clear and bright, and has no phase separation as determined by the Storage Stability Test.

2. An additive concentrate as claimed in claim 1, wherein the number average molecular weight ($M_n$) of the poly($C_2$ to $C_6$)alkylenyl chain(s) of the one or more poly($C_2$ to $C_6$)alkylenyl succinic anhydride(s) is 1500 to 4000 daltons.

3. An additive concentrate as claimed in claim 1, wherein the number average molecular weight ($M_n$) of the poly($C_2$ to $C_6$)alkylenyl chain(s) of the one or more poly($C_2$ to $C_6$)alkylenyl succinic anhydride(s) is 1700 to 3000 daltons.

4. An additive concentrate as claimed in claim 1, wherein the number average molecular weight ($M_n$) of the poly($C_2$ to $C_6$)alkylenyl chain(s) of the one or more poly($C_2$ to $C_6$)alkylenyl succinic anhydride(s) is 1500 to 3000 daltons.

5. An additive concentrate as claimed in claim 1, wherein the average saponification value (SAP value) of the one or more poly($C_2$ to $C_6$)alkylenyl succinic anhydride(s) is greater than or equal to 45, as measured in accordance with ASTM D94.

6. An additive concentrate as claimed in claim 1, wherein the one or more poly($C_2$ to $C_6$)alkylenyl succinic anhydride(s) is one or more polyisobutylenyl succinic anhydride(s) (PIBSA(s)).

7. An additive concentrate as claimed in claim 1, wherein the one or more poly($C_2$ to $C_6$)alkylenyl succinic anhydride (s) is present in an amount of from 3.0 to 5.0 mass % on an active ingredient basis, based on the total mass of the additive concentrate.

8. An additive concentrate as claimed in claim 1, wherein the one or more aliphatic ($C_{11}$ to $C_{23}$)hydrocarbyl fatty acid(s) is selected from the group consisting of: oleic acid, linoleic acid, linoelaidic acid, linolenic acid.

9. An additive concentrate as claimed in claim 1, wherein the one or more polyhydric ($C_2$ to $C_{20}$)alkanol(s) selected from glycerol, neopentyl glycol, trimethylolethane, trimethylolpropane, tri methylol butane, pentaerythritol, dipentaerythritol, tripentaerythritol and sorbitol.

10. An additive concentrate as claimed in claim 1, wherein the polyhydric ($C_2$ to $C_{2o}$)alkanol(s) is glycerol.

11. An additive concentrate as claimed in claim 1, wherein the one or more aliphatic ($C_7$ to $C_{29}$)hydrocarbyl fatty acid ester(s) is glycerol mono-oleate (GMO).

12. An additive concentrate as claimed in claim 1, wherein the one or more alkaline earth metal salicylate detergent(s) is one or more calcium salicylate detergent(s).

13. An additive concentrate for use in forming a lubricating oil composition, the additive concentrate comprising diluent oil of lubricating viscosity present in a minor amount of less than 50 mass %, based on the total mass of the additive concentrate, and a plurality of oil-soluble or oil-dispersible additives contained therein, wherein the combined amount of all of said plurality of additives in the additive concentrate is greater than 50 mass % on an active ingredient basis, based on the total mass of the additive concentrate, and wherein the plurality of additives include the following additives:

(A) one or more oil-soluble or oil-dispersible overbased calcium salicylate detergent(s) having a TBN at 100% active mass of 200 to 600 mg KOH/g, as measured in accordance with ASTM D 2896, present in an amount of from 5 to 20 mass % on an active ingredient basis, based on the total mass of the additive concentrate;

(B) glycerol mono-oleate present in an amount of from 1.0 to 7.5 mass on an active ingredient basis, based on the total mass of the additive concentrate; and (C) one or more oil-soluble or oil-dispersible poly (isobuteneyl) succinic anhydride(s) wherein:

i) the number average molecular weight ($M_n$) of the poly(isobuteneyl) chain(s) of the one or more poly (isobuteneyl) succinic anhydride(s) is 1700 to 3000 daltons;

ii) the poly(isobuteneyl) succinic anhydride(s) is present in an amount of from 1.5 to 7.5 mass % on an active ingredient basis, based on the total mass of the additive concentrate and has a succination ratio of 1.35 to 4.00;

iii) the poly(isobuteneyl) succinic anhydride(s) is present in an effective amount to stabilise the additive concentrate, where the additive concentrate does not show a sediment volume over 0.05 mass %, is clear and bright, and has no phase separation as determined by the Storage Stability Test.

14. The additive concentrate of claim 13, wherein the poly(isobuteneyl) succinic anhydride(s) has a succination ratio of 1.45 to 3.50.

15. The additive concentrate of claim 13, wherein the number average molecular weight ($M_n$) of the poly (isobuteneyl) chain(s) of the one or more poly(isobuteneyl) succinic anhydride(s) is $M_n$ of 1700 to 2500 daltons.

16. An additive concentrate as claimed in claim 1, wherein the number average molecular weight ($M_n$) of the poly($C_2$ to $C_6$)alkylenyl chain(s) of the one or more poly($C_2$ to $C_6$)alkylenyl succinic anhydride(s) is 1500 to 4000 daltons.

17. The additive concentrate of claim 1, wherein the poly(isobuteneyl) succinic anhydride(s) has a succination ratio of 1.50 to 2.75.

18. The additive concentrate of claim 13, wherein the poly(isobuteneyl) succinic anhydride(s) has a succination ratio of 1.50 to 2.75.

19. The additive concentrate of claim 1, wherein the poly(isobuteneyl) succinic anhydride(s) has a succination ratio of 1.45 to 3.50.

20. An additive concentrate for use in forming a lubricating oil composition, the additive concentrate comprising diluent oil of lubricating viscosity present in a minor amount of less than 50 mass %, based on the total mass of the additive concentrate, and a plurality of oil-soluble or oil-dispersible additives contained therein, wherein the combined amount of all of said plurality of additives in the additive concentrate is greater than 50 mass % on an active ingredient basis, based on the total mass of the additive concentrate, and wherein the plurality of additives include the following additives:

(A) one or more oil-soluble or oil-dispersible overbased calcium salicylate detergent(s) having a TBN at 100% active mass of 250 to 600 mg KOH/g, as measured in accordance with ASTM D 2896, present in an amount of from 5 to 25 mass % on an active ingredient basis, based on the total mass of the additive concentrate;

(B) glycerol mono-oleate present in an amount of from 1.0 to 10.0 mass % on an active ingredient basis, based on the total mass of the additive concentrate; and (C) one or more oil-soluble or oil-dispersible poly (isobuteneyl) succinic anhydride(s) wherein:

i) the number average molecular weight ($M_n$) of the poly(isobuteneyl) chain(s) of the one or more poly (isobuteneyl) succinic anhydride(s) is 1700 to 3000 daltons;

ii) the poly(isobuteneyl) succinic anhydride(s) is present in an amount of from 1.5 to 7.5 mass % on an active ingredient basis, based on the total mass of the additive concentrate;

iii) the poly(isobuteneyl) succinic anhydride(s) has a succination ratio of 1.50 to 2.75; and iv) the poly(isobuteneyl) succinic anhydride(s) is present in an effective amount to stabilise the additive concentrate;

where (A) and (C) are blended into the additive concentrate.

21. The additive concentrate of claim 13, wherein overbased calcium salicylate detergent(s) has a TBN at 100% active mass of at least 250 to 600 mg KOH/g, as measured in accordance with ASTM D2896.

22. The additive concentrate of claim 1, wherein overbased alkaline earth metal salicylate detergent(s) has a TBN at 100% active mass of 250 to 600 mg KOH/g, as measured in accordance with ASTM D2896.

23. An additive concentrate as claimed in claim 1, wherein:

a) the number average molecular weight ($M_n$) of the poly($C_2$ to $C_6$)alkylenyl chain(s) of the one or more poly($C_2$ to $C_6$)alkylenyl succinic anhydride(s) is 1700 to 3000 daltons; and b) the one or more polyhydric ($C_2$ to $C_{20}$)alkanol(s) is glycerol; and c) the one or more alkaline earth metal salicylate detergent(s) is one or more calcium salicylate detergent(s); and d) the one or more poly($C_2$ to $C_6$)alkylenyl succinic anhydride(s) is one or more polyisobutylenyl succinic anhydride(s).

24. The additive concentrate of claim 23, wherein the poly(isobuteneyl) succinic anhydride(s) has a succination ratio of 1.45 to 3.50.

25. The additive concentrate of claim 1 wherein the one or more oil-soluble or oil-dispersible poly($C_2$ to $C_6$)alkylenyl succinic anhydride(s) has a succination ratio of 1.35 to 3.50.

26. The additive concentrate of claim 1 wherein the one or more aliphatic ($C_{11}$ to $C_{23}$)hydrocarbyl fatty acid(s) is selected from the group consisting of: myristoleic acid, palmitoleic acid, sapienic acid, hexadecatrienoic acid, oleic acid, stearidonic acid, elaidic acid, vaccenic acid, linoleic acid, linoelaidic acid, linolenic acid, arachidonic acid, eicosapentaenoic acid, eicosenoic acid, erucic acid, docosahexaenoic acid, docosahexaenoic acid, tetracosapentaenoic acid and tetracosatetraenoic acid.

* * * * *